US006178912B1

(12) United States Patent
Niemier

(10) Patent No.: US 6,178,912 B1
(45) Date of Patent: Jan. 30, 2001

(54) SIT-ON-TOP KAYAK WITH SPACE EFFICIENT COCKPIT AREA

(75) Inventor: Timothy A. Niemier, Bellingham, WA (US)

(73) Assignee: Old Town Canoe Company, Old Town, MA (US)

( * ) Notice: Under 35 U.S.C. 154(b), the term of this patent shall be extended for 0 days.

This patent is subject to a terminal disclaimer.

(21) Appl. No.: 09/545,252

(22) Filed: Apr. 7, 2000

Related U.S. Application Data

(63) Continuation-in-part of application No. 09/415,187, filed on Oct. 7, 1999, which is a continuation of application No. 08/557,436, filed on Nov. 14, 1995, now Pat. No. 5,964,177, which is a continuation-in-part of application No. 29/045,310, filed on Oct. 16, 1995, which is a continuation of application No. 29/020,506, filed on Mar. 25, 1994, now Pat. No. Des. 377,473, which is a continuation-in-part of application No. 29/011,308, filed on Aug. 2, 1993, now abandoned.

(51) Int. Cl.[7] ..... B63B 35/00
(52) U.S. Cl. ..... 114/347; 114/363
(58) Field of Search ..... 114/347, 363; D12/300, 302

(56) References Cited

U.S. PATENT DOCUMENTS

| | | |
|---|---|---|
| D. 319,211 | 8/1991 | Kruse . |
| D. 322,774 | 12/1991 | Arcouette . |
| D. 341,351 | 11/1993 | Arcouette . |
| D. 391,916 | 3/1998 | Masters . |
| D. 400,155 | 10/1998 | Masters . |
| 3,584,590 | 6/1971 | Rings et al. . |
| 4,106,143 | 8/1978 | Lucas . |
| 4,378,747 | 4/1983 | Beatty et al. . |

(List continued on next page.)

FOREIGN PATENT DOCUMENTS

| | | | |
|---|---|---|---|
| 424910 | 2/1926 | (DE) . | |
| 2673416A1 | 9/1992 | (FR) . | |
| 2686055 * | 7/1993 | (FR) | 114/363 |
| 2172553A | 9/1986 | (GB) . | |
| 7903845 | 11/1980 | (NE) . | |
| WO 99/06272 | 11/1999 | (WO) . | |

OTHER PUBLICATIONS

Scupper Pro Product Brochure, Ocean Kayak, Inc.
Scrambler Product Brochure, Ocean Kayak, Inc.
Zuma Two Product Brochure, Ocean Kayak, Inc.
Paddler, Selected pages from Jul. 1992 Issue.

* cited by examiner

*Primary Examiner*—Ed Swinehart
(74) *Attorney, Agent, or Firm*—Michael R. Schacht; Hughes & Schacht, P.S.

(57) ABSTRACT

A sit-on-top kayak having a seating and footwell arrangement that allows users to sit comfortably in a relatively small cockpit area defined by the kayak. Preferably, two or three seating surfaces and footwells are employed. The footwells associated with any given seating surface straddle the seating surface in front of the given seating surface if the given seating surface is not the forwardmost seating surface.

13 Claims, 13 Drawing Sheets

U.S. PATENT DOCUMENTS

| | | | |
|---|---|---|---|
| 4,407,216 | 10/1983 | Masters . | |
| 4,480,579 | 11/1984 | Masters . | |
| 4,503,799 | 3/1985 | Masters . | |
| 4,520,747 | 6/1985 | Masters . | |
| 4,583,480 | 4/1986 | Hamilton et al. . | |
| 4,589,365 | 5/1986 | Masters . | |
| 4,660,490 | 4/1987 | Broadhurst . | |
| 4,710,143 | 12/1987 | Boulanger . | |
| 4,715,311 | 12/1987 | Masters . | |
| 4,744,327 | 5/1988 | Masters . | |
| 4,820,216 | 4/1989 | Masters . | |
| 4,942,840 | 7/1990 | Masters et al. . | |
| 4,945,852 | 8/1990 | Kobayashi . | |
| 4,980,112 | 12/1990 | Masters . | |
| 5,042,416 | 8/1991 | Arcouette . | |
| 5,076,194 | 12/1991 | Curtis et al. . | |
| 5,094,607 | 3/1992 | Masters . | |
| 5,134,964 | 8/1992 | Masters . | |
| 5,189,974 | 3/1993 | Masters . | |
| 5,367,975 | 11/1994 | Hamilton et al. . | |
| 5,397,525 | 3/1995 | Niemier . | |
| 5,406,904 | 4/1995 | Kobayaski . | |
| 5,493,982 | 2/1996 | Carpenter et al. . | |
| 5,540,176 | 7/1996 | Galea . | |
| 5,855,180 | 1/1999 | Masters . | |
| 5,964,177 * | 10/1999 | Niemier | 114/347 |
| 5,970,903 | 10/1999 | McDonough et al. . | |

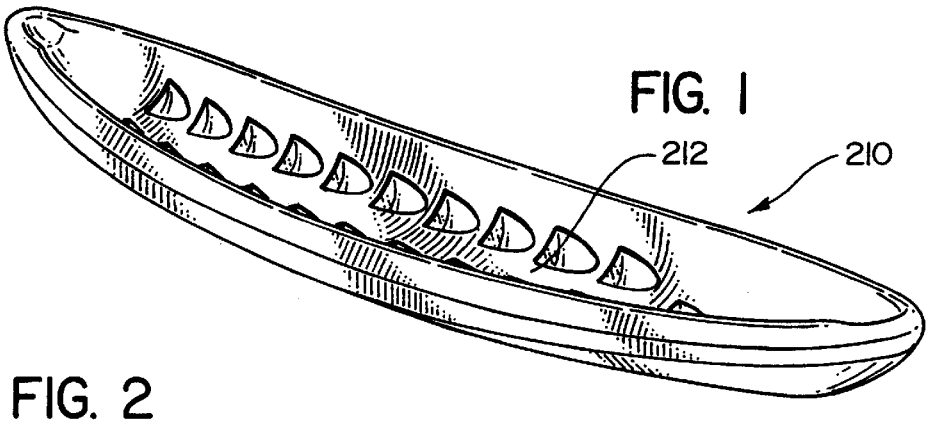
FIG. 1
FIG. 2
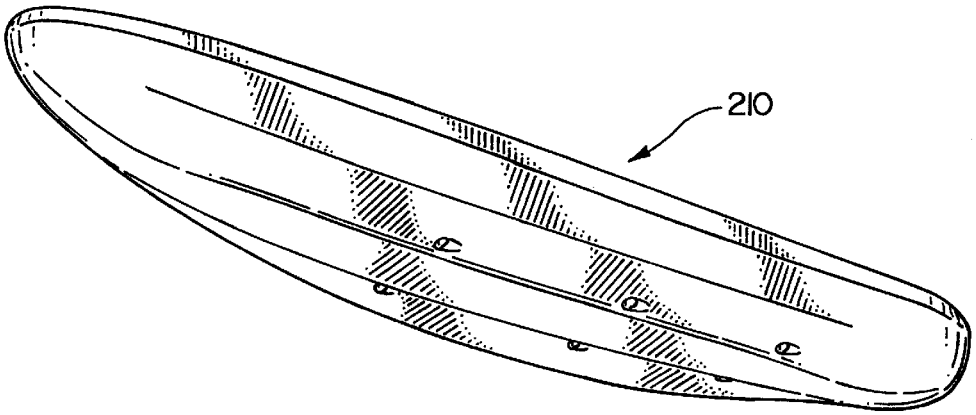
FIG. 3
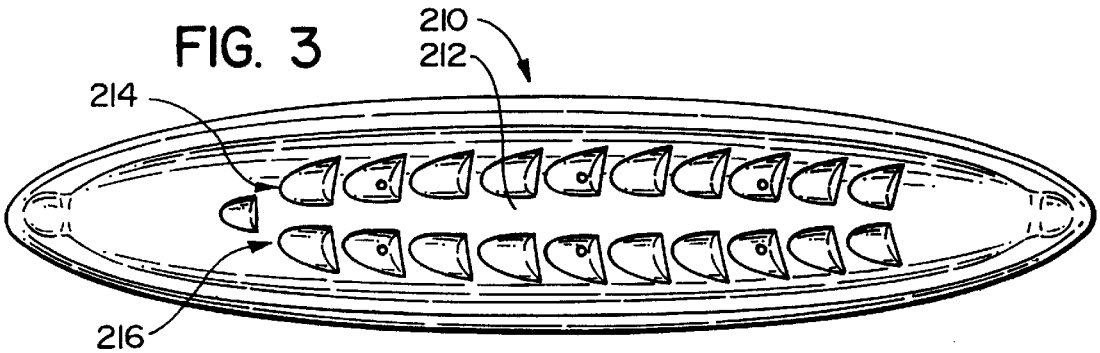
FIG. 4
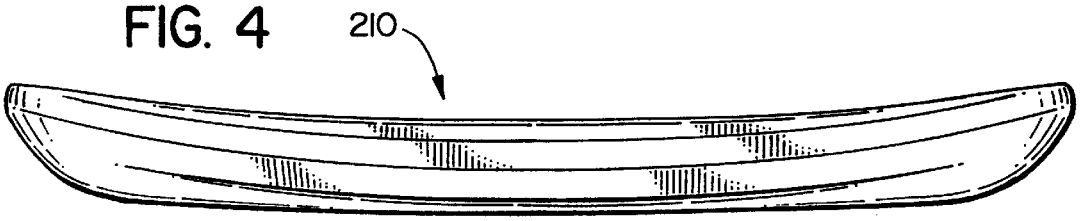

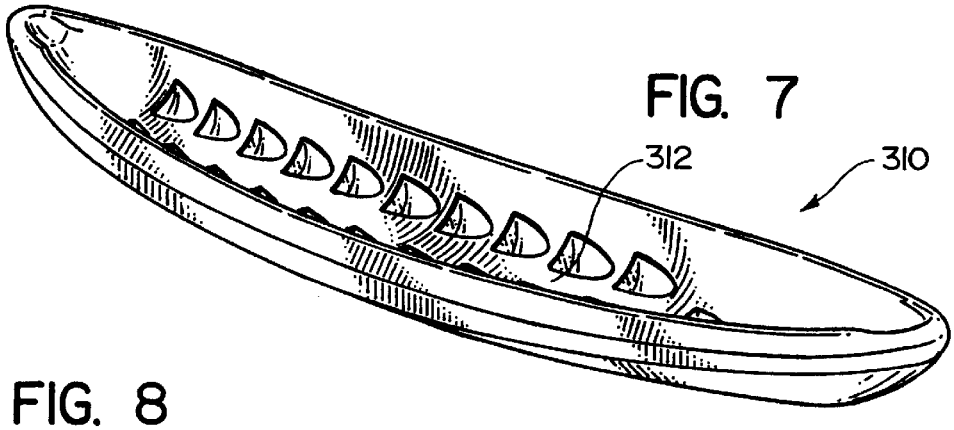
FIG. 7
FIG. 8
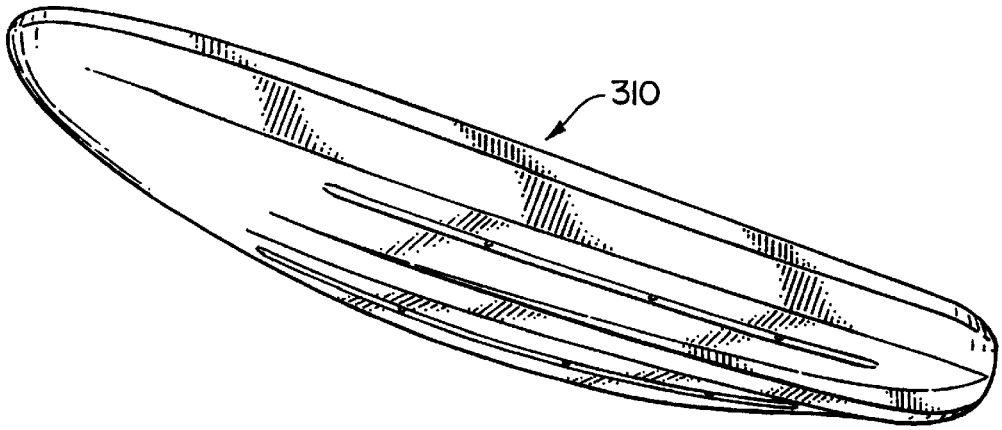
FIG. 9
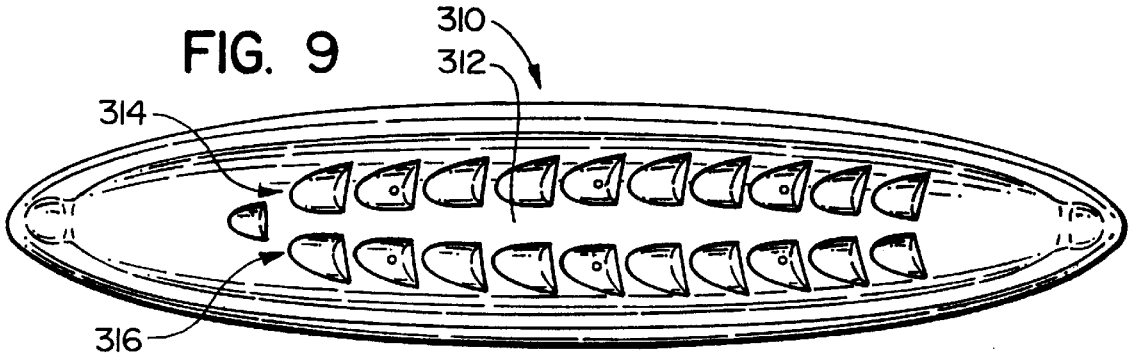
FIG. 10
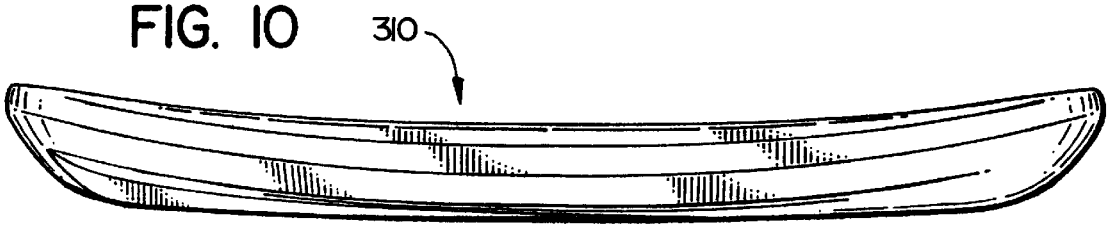

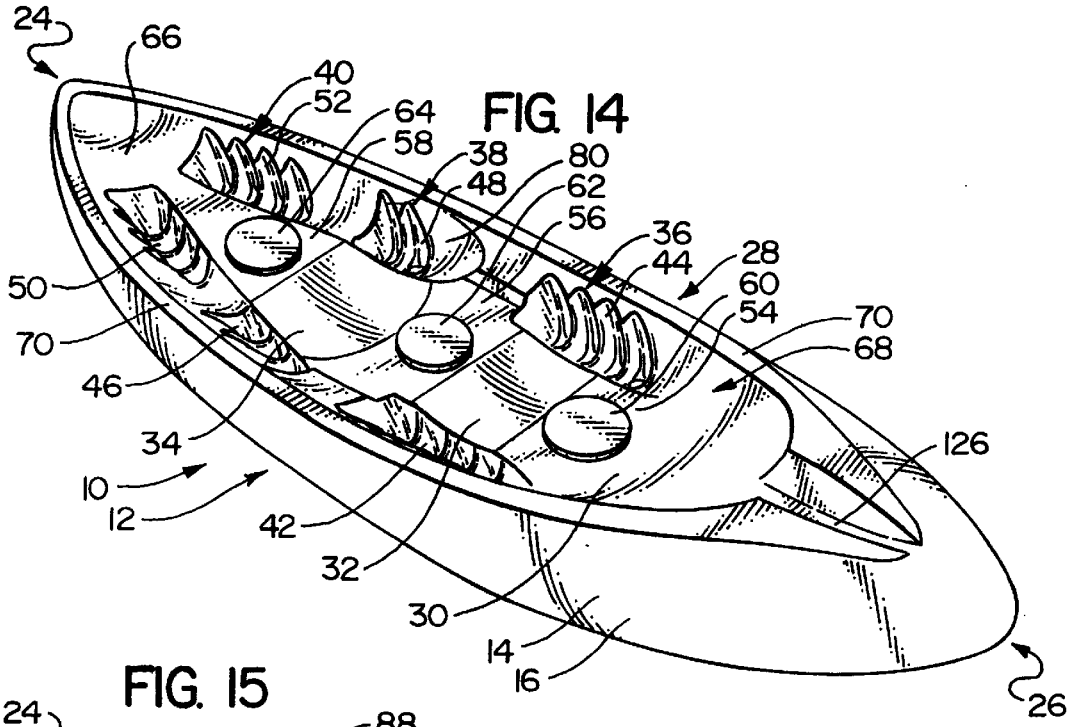
FIG. 14
FIG. 15
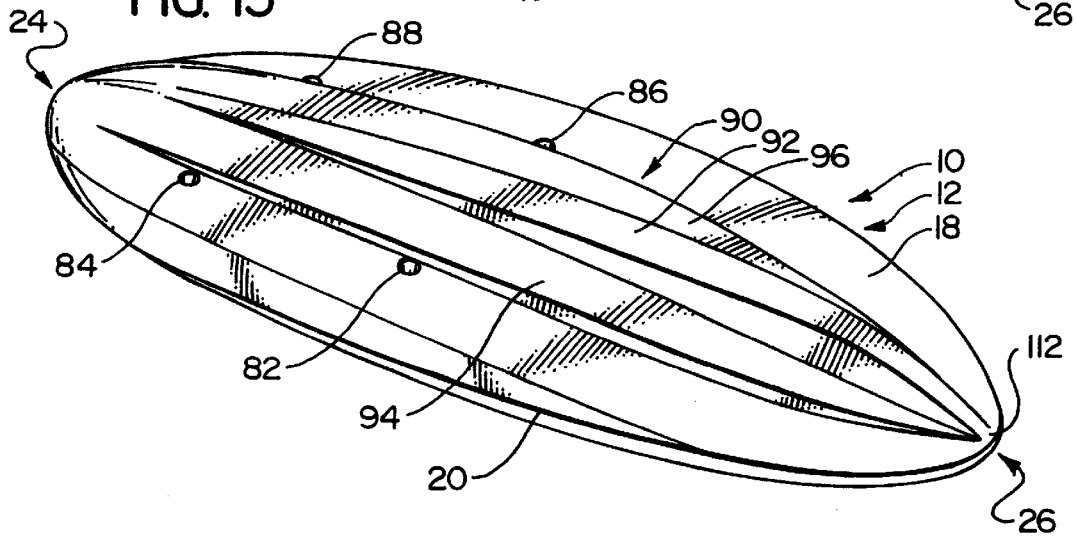
FIG. 16
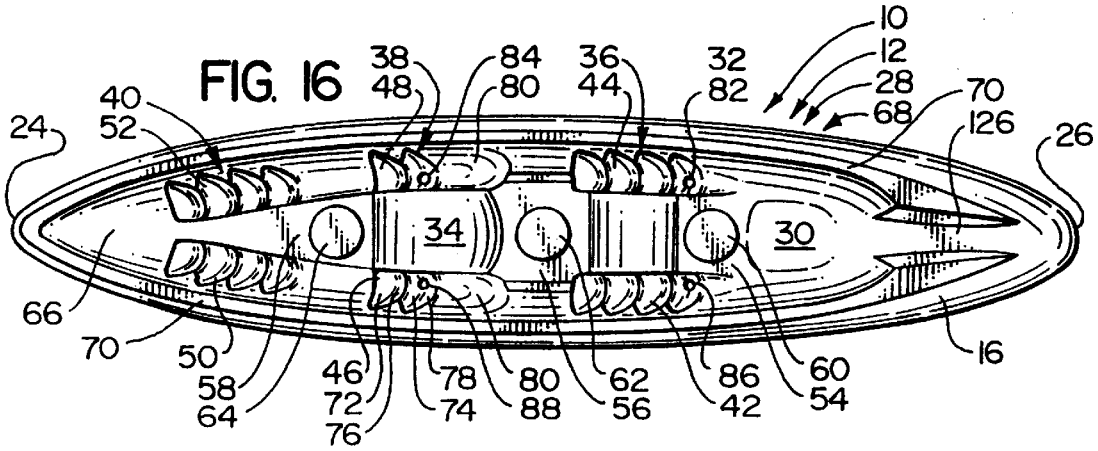

410
412
414
416
426
430
454
456
458
434
22
22
470
432
482a
436
442
428
468
446
480
486
438
482b
450
440
482c
474
466
424
472
478c
452
478b
448
470
484
476
478a
444

482b
486
470
488
490
480
476
418
416
412
414

482b
488
494
496
490
492
480
476

510
512
514
516
526
530
570
554
574
572
544
536
532
556
528
542
572
574
580
570
538
534
548
546
558
582
540
566
524

610
612
614
616
626
630
654
676
632
656
644
636
642
628
680
882
638
648
646
624

620
634
684
674
658
640
650
652
672
670

710
712
714
716
726
770
730
732
774
736
744
754
742
772
786
728
768
784
756
738
748
734
746
776
778
29
29
758
782
740
752
770
780
750
766
724

792
776
794
784
770
796
798
790
718
712

810
830
854
856
834
858
874
832
878
882
886
888
872
884
892
890
876
880

SIT-ON-TOP KAYAK WITH SPACE EFFICIENT COCKPIT AREA

RELATED APPLICATIONS

This is a continuation-in-part of application Ser. No. 09/415,187 filed Oct. 7, 1999, which is a continuation of application Ser. No. 08/557,436 filed Nov. 14, 1995, now U.S. Pat. No. 5,964,177, which is a continuation-in-part of application Ser. No. 29/045,310 fled Oct. 16, 1995, which is a continuation of application Ser. No. 29/020,506 filed Mar. 25, 1994, now U.S. Pat. No. Des. 377,473, which is a continuation-in-part of application Ser. No. 29/011,308 filed Aug. 2, 1993, abandoned.

TECHNICAL FIELD

The present invention relates to human propelled water craft such as kayaks and canoes and, more particularly, rotationally molded sit-on-top kayaks having open cockpits.

BACKGROUND OF THE INVENTION

Conventional kayaks comprise a hollow shell in which the kayaker's lower body and legs are received through an opening in the shell. These kayaks require a certain amount of skill to operate as the kayaker must learn to "self-rescue", or roll the kayak into an upright position if the kayak is tipped over.

An alternative type of kayak has been developed and has gained increasing acceptance. This new type of kayak is referred to in the industry and herein as a sit-on-top kayak. As this name suggests, the user of a sit-on-top kayak sits in an open cockpit on top of the kayak hull. The sit-on-top kayak is somewhat similar to a surfboard in overall shape, but normally has a generally V-shaped hull portion and a deeper draft to allow better tracking. Modern sit-on-top kayaks are conventionally formed out of polyethylene using a rotational molding process to obtain a sealed, hollow shell. The process of manufacturing rotationally-molded polyethylene sit-on-top kayaks is generally discussed in U.S. Pat. No. 5,397,525 issued to the present Applicant.

The kayak discussed in the aforementioned '525 patent is a single seat kayak designed for use by one person. A seating surface, footwell, and spacing surface are formed in the cockpit of the kayak shown in the '525 patent. The Applicant is also aware of a number of two-person kayaks in which two seating surfaces and footwells are provide. The Applicant is aware of a three-person kayak where each person has a separate cockpit area; this kayak is very long and not practical for many people because of its length. A comfortable, stable three-person kayak has thus been difficult to manufacture because the overall length of the boat can be impractical.

The need thus exists for a sit-on-top kayak design that provides three seating surfaces and footwells associated therewith, but does not result in a boat that is inconveniently long.

From the foregoing, it should be clear that one primary object of the present invention is to provide an improved sit-on-top kayak design.

SUMMARY OF THE INVENTION

The present invention may be embodied as a sit-on-top kayak having a seating and footwell arrangement that allows three people to sit comfortably in a cockpit of a kayak. Inside the cockpit, three seating surfaces and footwells are formed. The footwells associated with the two rearmost seating surfaces are each divided into two footwell portions that straddle the two forward seating surfaces.

BRIEF DESCRIPTION OF THE DRAWINGS

FIG. 1 is an isometric view of a first embodiment of a water craft of the present invention, taken from an upper side end location;

FIG. 2 is an isometric view of the first embodiment of a water craft taken from a position below and to one side thereof;

FIG. 3 is a top plan view of the first embodiment;

FIG. 4 is a side elevational view of the first embodiment;

FIG. 7 is an isometric view of a second embodiment of a water craft of the present invention, taken from an upper side end location;

FIG. 8 is an isometric view of the second embodiment of a water craft taken from a position below and to one side thereof;

FIG. 9 is a top plan view of the second embodiment;

FIG. 10 is a side elevational view of the second embodiment;

FIG. 14 is an isometric view of a third embodiment of a water craft of the present invention, taken from an upper side end location;

FIG. 15 is an isometric view of the third embodiment of my water craft taken from a position below and to one side thereof;

FIG. 16 is a top plan view of the third embodiment;

DETAILED DESCRIPTION

Figure 5:
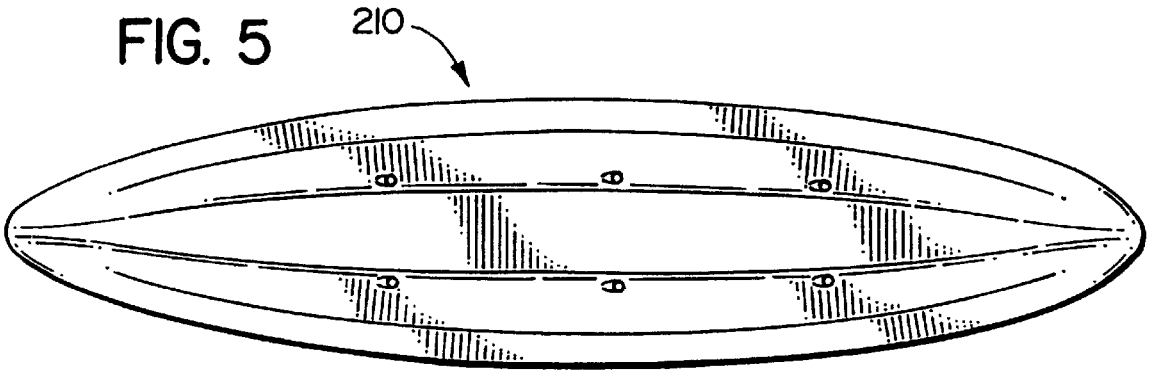
FIG. 5 is a bottom plan view of the first embodiment.
Figure 6:
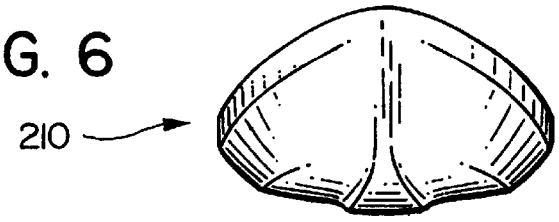
FIG. 6 is an elevational view of an end of the first embodiment of a water craft.
Figure 11:
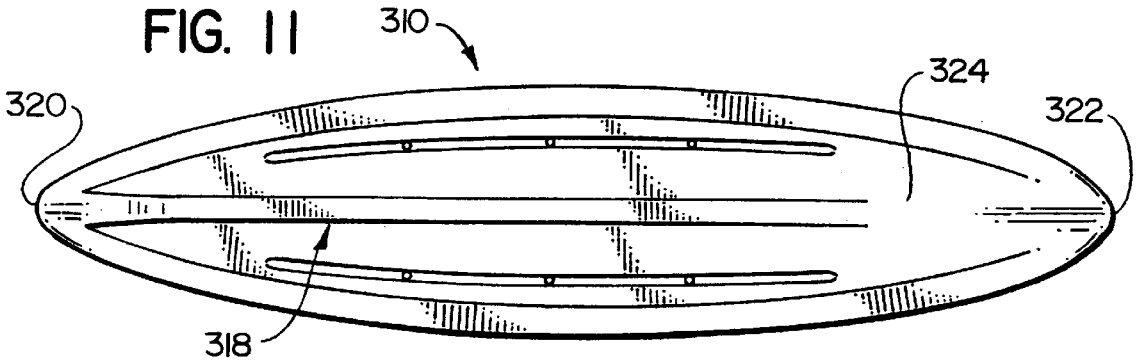
FIG. 11 is a bottom plan view of the second embodiment.
Figure 12:
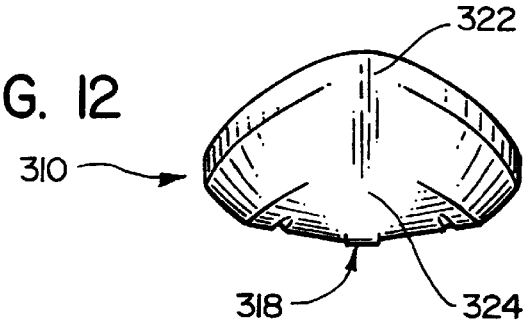
FIG. 12 is an elevational view of a first end of the second embodiment of a water craft.
Figure 13:
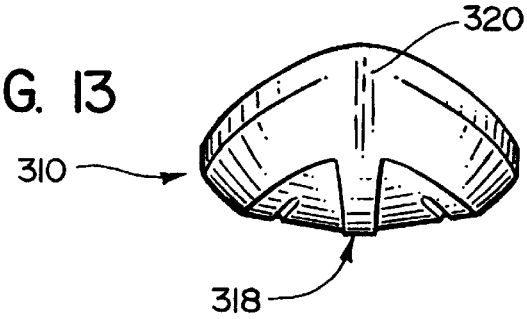
FIG. 13 is an elevational view of a second end of the second embodiment of a water craft.
Figure 17:
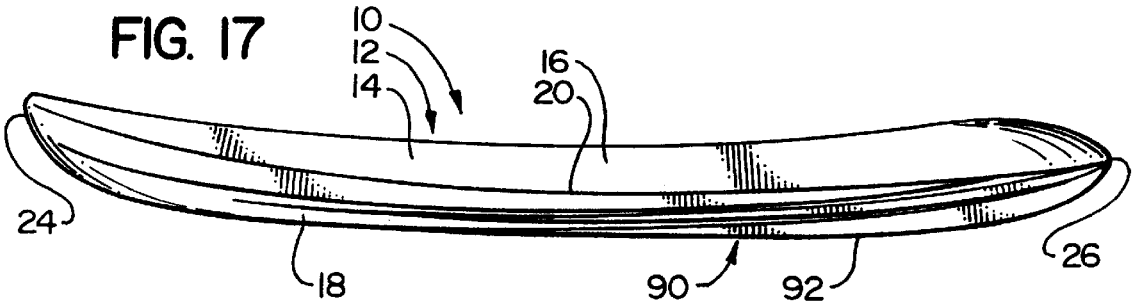
FIG. 17 is a side elevational view of the third embodiment.

The present invention is a seating arrangement for use in small watercraft such as kayaks that are limited in size and weight. The present invention may be embodied in many different configurations. A number of preferred configurations will be discussed separately below.

A. First Embodiment

Referring initially to FIGS. 14–20 of the drawing, depicted therein at 10 is a sit-on-top kayak constructed in accordance with, and embodying, the principles of the present invention.

The kayak 10 has a hull 12 defining a hull outer surface 14. The hull outer surface 14 has an upper portion 16 and a lower portion 18 separated by a parting line 20 extending around the perimeter of the kayak 10 above the water line. The hull 12 has a bow 24 and a stern 26. The kayak 10 further comprises a cockpit area 28.

Within the cockpit area 28 are first, second, and third seating surfaces 30, 32, and 34. Also in the cockpit area 28 are first, second, and third footwells 36, 38, and 40. The present invention is of particular use in the context of a kayak having three seating areas and associated footwells as disclosed herein. However, the principles of the present invention may have more general application to any kayak where cockpit space is limited. In particular, the present invention may be applied to kayaks with two seating areas and associated footwells or to kayaks with four or more seating areas and associated footwells.

The first seating area 30 is located generally adjacent to the stern 26 of the kayak 10 and will be referred to as the aft seating surface. The second seating surface 32 is located forward of the aft seating surface 30 and will be referred to as the middle seating surface. The third seating surface 34 is the forwardmost of the three seating surfaces and will be referred to as the forward seating surface.

The footwell 36 is associated with the aft seating surface 30 and will be referred to as the aft footwell. The footwell 38 is associated with the middle seating surface 32 and will be referred to as the middle footwell. Similarly, the third footwell 40 is associated with the forward seating surface 34 and will be referred to as the forward footwell.

Each of the exemplary footwells 36, 38, and 40 comprises first and second footwell portions. In particular, the forward footwell 36 comprises a first portion 42 and a second portion 44. The middle footwell 38 comprises a first portion 46 and a second portion 48. The forward footwell 40 comprises a first portion 50 and a second portion 52. Other footwell arrangements are possible, however, as will be described in further detail below.

In the exemplary cockpit area 28, the middle seating surface 32 is arranged between the first and second aft footwell portions 42 and 44. Similarly, the forward seating surface 34 is arranged between the first and second middle footwell portions 46 and 48.

By separating the footwells into first and second portions and arranging a seating surface between these footwell portions, it is possible to place three seating surfaces in the boat 20 and still have the length of the boat 20 from the bow 24 to the stern 26 be practical.

As briefly mentioned above, the principles of the present invention may be applied to kayaks having two seating surfaces as well as to kayaks having more than three seating surfaces. In any of these arrangements, the seating surface closest to the bow of the boat will be defined as the forwardmost seating surface. The footwells associated with at least a given one of the seating surfaces that is not the forwardmost seating surface will straddle the seating surface immediately in front of the given seating surface.

The exemplary kayak 10 further comprises first, second, and third spacing surfaces 54, 56, and 58. In the exemplary kayak 10, hatches formed in these surfaces 54, 56, and 58 allow access to the interior of the kayak 10, and hatch covers 60, 62, and 64 may be employed to cover the hatches to keep the interior of the kayak 10 dry. The use hatches and/or hatch covers 60, 62, and 64 is preferred, but one or more of the hatches and/or hatch covers 60, 62, and 64 may be eliminated and the resulting kayak could fall within the scope of the present invention.

The first spacing surface 54 is arranged between the aft seating surface 30 and middle seating surface 32 and is referred to as the aft spacing surface. The second spacing surface 56 is arranged between the middle seating surface 32 and the forward seating surface 34 and will be referred to herein as the middle spacing surface. The third spacing surface 58 is arranged in front of the forward seating surface 34 and will be referred to as the forward spacing surface. The forward spacing surface 58 is arranged between the first and second forward footwell portions 50 and 52.

Referring now to FIG. 16, it can be seen that the various seating surfaces 30–34 and spacing surfaces 54–58 are arranged in the following sequence from stern 26 to bow 24: aft seating surface 30; aft spacing surface 54; middle seating surface 32; middle spacing surface 56; forward seating surface 34; and forward spacing surface 58. Between the forward spacing surface 58 and the bow 54 is a bow upper surface 66.

As shown in FIG. 16, these surfaces 30, 54, 32, 56, 34, 58, and 66 form a seating deck 68 that extends through the middle of the cockpit area 58 and has contours generally matching that of a perimeter wall 70 that extends almost entirely around the cockpit area 28. This seating deck 68 divides the footwells 36, 38, and 40 into the footwell portions 42–52 as described above.

The seating surfaces 30, 32, and 34 are preferably slightly concave or contoured to provide a more comfortable seating area. However, any surface that is comfortable for an average person would be acceptable as a seating surface. Accordingly, a flat surface or a slightly convex surface, which would not be uncomfortable for the average person to sit on, would be considered a surface that is contoured as a seating surface.

The spacing surfaces 54, 56 and 58 are preferably planar, although they are not necessarily parallel with each other or horizontally aligned.

The exemplary footwell portions 42–52 briefly described above are shaped to allow the kayaker to brace his or her feet while paddling. In particular, each of the footwell portions 42–52 comprises a plurality of upwardly and forwardly slanted bracing surfaces such as those shown at 72 and 74 in FIG. 16. Spaced immediately behind each of these bracing surfaces 72 and 74 is a resting surface 76 and 78, respectively. The back of the kayaker's heel will rest on the resting surfaces 76 and 78, while the bottom of the kayaker's feet will engage the bracing surfaces 72 and 74.

Each of the exemplary footwell portions 42, 44, 50, and 52 of the forward and aft footwells 36 and 40 comprises four bracing surfaces such as the surfaces 72 and 74 and two resting surfaces such as the resting surfaces 76 and 78. The footwell portions 46 and 48 of middle footwell 38 each comprise only two bracing surfaces 72 and 74 and two resting surfaces 76 and 78.

Each of the footwell portions 46 and 48 of the middle footwell 38 additionally comprises a forwardly and downwardly slanted rear surface such as the surface 80 identified in FIG. 16. These rear surfaces 80 are forwardly and downwardly slanted to allow the kayaker sitting on the middle seating surface 32 to place his or her feet on one of the resting surfaces 76 and 78 without the back of the user's leg rubbing against any surface of the kayak 10.

The footwell portions 42 and 44 of the first footwell 36 and portions 46 and 48 of the second footwell 38 are generally parallel to each other. The footwell portions 50 and 52 of the forward footwell 40 are inwardly canted towards each other such that the spacing surface 58 therebetween is generally triangular or ogival in overall shape.

As will be described below, other shapes, configurations, and/or arrangements of footwell portions may be employed by the present invention. Some footwell portions may not have discrete bracing or resting surfaces, while others may have only a resting surface or a bracing surface.

The seating deck 68 described above on which the seating surfaces 30, 32, and 34 are formed and which extends between the footwell portions 42–48 of the footwells 36, 38, and 40 provides a comfortable seating area for three kayakers, yet still allows the kayakers to rest and brace their feet in a comfortable manner during kayaking.

Referring now to FIGS. 15 and 16, it can be seen that the kayak 10 further comprises four drain holes 82, 84, 86, and 88 that extend between the cockpit area 28 and the underside of the kayak 10. These drain holes 82–88 are located at the juncture of the rearmost resting surface and bracing surface in the footwell portions 42–48 of the aft and middle footwells 36 and 38. The footwell portions 42–48 are configured such that water therein will drain into the drain hulls 82–88 during normal use of the kayak.

Referring now to FIGS. 15 and 17–20, shown therein is an exemplary keel structure 90 that is designed to help the kayak 10 track in a straight line when desired, allow the kayak 10 to be turned easily when desired, yet creates a stable kayak that exhibits low resistance during use. This keel structure 90 is thus preferred, but other keel structures may be used when implementing the principles of the present invention.

The exemplary keep structure 90 extends downwardly from the hull 12. The keel structure 90 comprises a keel 92 and first and second winglets 94 and 96. The keel 92 is defined by a keel bottom surface 98 and first and second keel side surfaces 100 and 102. The first winglet 94 has a winglet bottom surface 104 and a first winglet outer surface 106. Similarly, the second winglet 96 has a second winglet bottom surface 108 and a second winglet outer surface 110.

Figure 18:
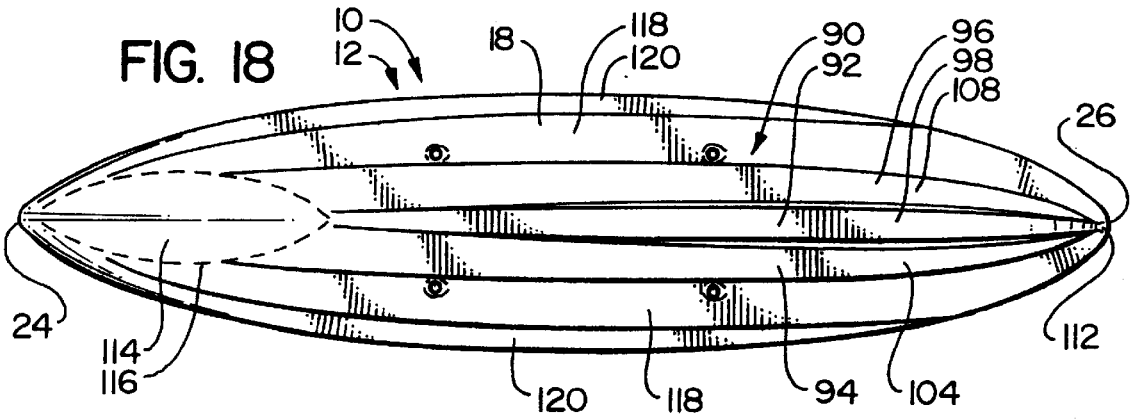
FIG. 18 is a bottom plan view of the third embodiment.
Figure 19:
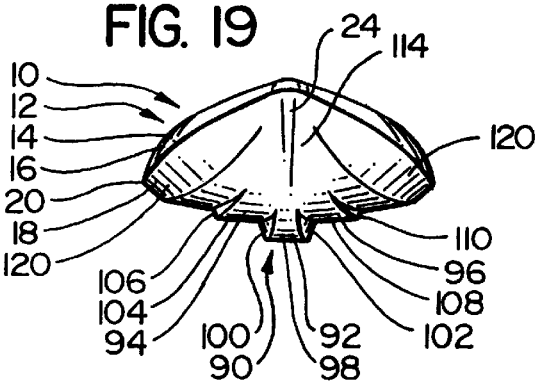
FIG. 19 is an elevational view of a first end of the third embodiment of a water craft of FIG. 15.
Figure 20:
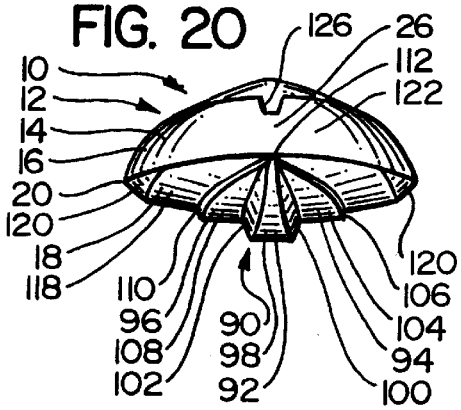
FIG. 20 is an elevational view of a second end of the third embodiment of FIG. 15.

The keel and winglet bottom surfaces 98, 104, and 108 are smoothly and continuously curved from the stern 26 towards the bow 24 of the kayak 10. In particular, as shown in FIG. 18, these surfaces terminate at a point 112 adjacent to the stern 26 and at a bow hull portion 114 of the hull lower surface 18 adjacent to the bow 24. The bow hull surface portion 114 is generally circumscribed by a dashed line 116 in FIG. 18.

The keel 92 and first and second winglets 94 and 96, like the keel and winglet lower surfaces 98, 104, and 108, terminate at the rear at the point 112 and towards the front of the kayak at the bow hull surface 114. It can be seen from FIG. 18 that the keel structure 90 does not extend along the entire underside of the hull 12. To the contrary, it terminates approximately ⅔ to ¾ of the way from the stern 26 to the bow 24 of the kayak 10.

The keel 92 extends into the water when the kayak is in use to provide improved tracking. However, because it does not extend the entire length of the kayak, the keel 92 allows the kayak 10 to be easily turned, which increases the maneuverability of the kayak 10.

The winglets 94 and 96 create a structure that almost acts like a narrow kayak hull underneath the kayak hull 12. Thus, when the kayak 10 is lightly loaded, only the keel 92, first winglet 94, and second winglet 96 will engage the water. This effectively narrows the width of the kayak 10 that is in contact with the water and thus lowers the resistance under such lightly loaded conditions. If larger loads are placed in the kayak (i.e., one person on each of the seating surfaces 30, 32, and 34). The entire keel structure 90, including the winglets 94 and 96, will be submerged and the water will engage the hull surface 118. This will result in increased resistance but improved stability of the kayak 10.

The hull 12 further comprises beveled surfaces 120 formed along the bottom surface 18 thereof. These beveled surfaces 120 extend from the bow hull bottom surface portion 114 almost to the stern 26. These surfaces 120 are upwardly and outwardly canted and normally will not engage the water to create resistance to travel but will engage the water under heavy or unevenly distributed loads, resulting in a more stable craft.

The upper surface 16 of the hull 12 is smoothly contoured from the parting line 20 up to the perimeter wall 70 defining the cockpit area 28. The perimeter wall 70 extends substantially around the cockpit area, although a notch 126 is formed in the perimeter wall 70 adjacent to the stern 26. The entire cockpit area 28 is shifted slightly towards the bow of the kayak 10 to provide a more stable distribution of weight therein.

B. Second Embodiment

Shown at 210 in FIGS. 1–6 is another kayak embodying the principles of the present invention. This kayak 210 has a cockpit area in which is formed an elongate seating deck 212 arranged between first and second footwell portions 214 and 216.

C. Third Embodiment

Depicted at 310 in FIGS. 7–13 is a kayak in which a seating deck 312 is arranged between first and second footwell portions 314 and 316. This kayak 310 further comprises a keel structure 318 that extends from a point adjacent to a stern 320 of the kayak 310 towards a bow 322 thereof. The keel structure 318 terminates in a bow hull lower surface 324 located adjacent to the bow 322.

D. Fourth Embodiment

Figure 21:
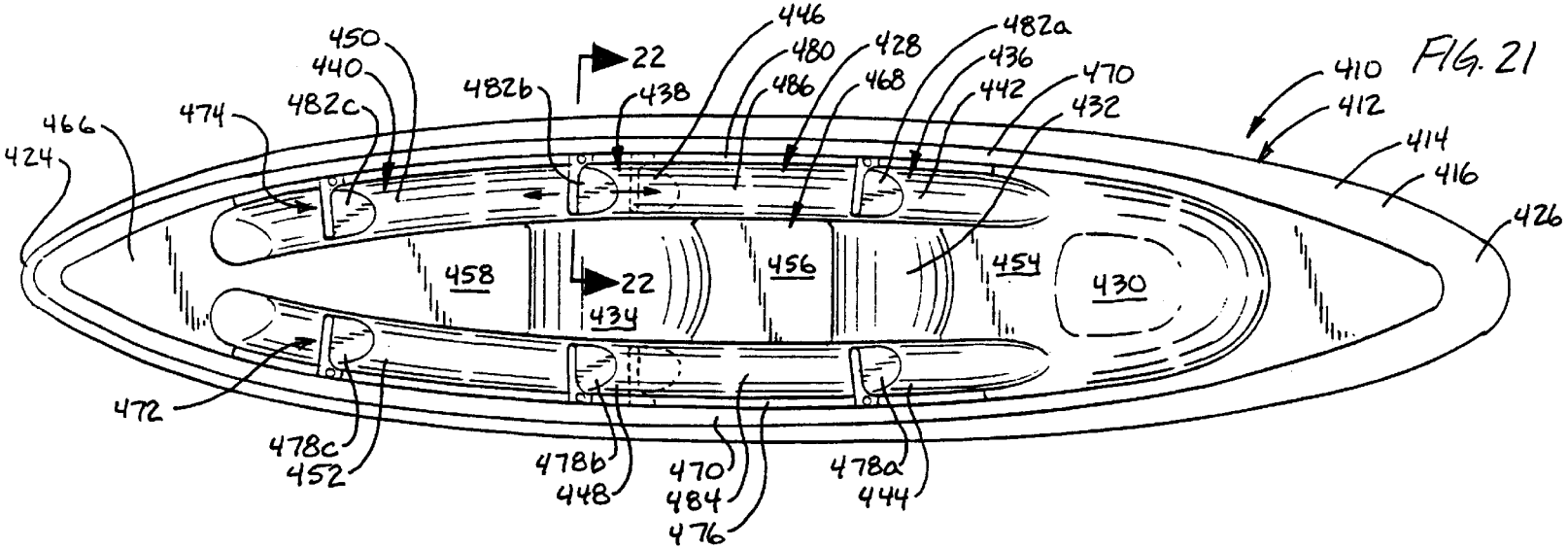
FIG. 21 is a top plan view of a fourth embodiment of a water craft constructed in accordance with the present invention.
Figure 22:
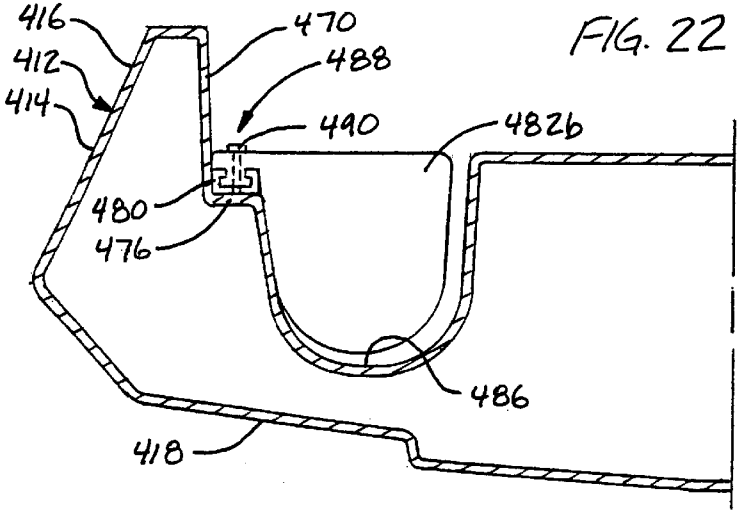
FIG. 22 is a partial section view taken along lines 22 in FIG. 21.
Figure 23:
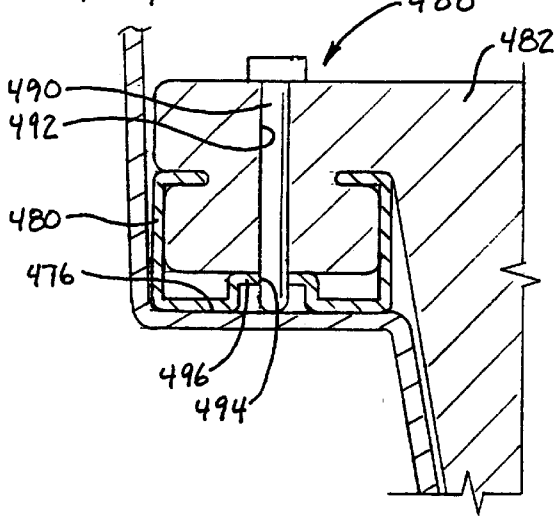
FIG. 23 is a section view also taken along lines 22 in FIG. 21 showing details of a locking system employed by the kayak of FIG. 21.

Referring now to FIGS. 21–23 of the drawing, depicted therein at 410 is a sit-on-top kayak constructed in accordance with, and embodying, the principles of the present invention.

The kayak 410 has a hull 412 defining a hull outer surface 414. The hull outer surface 414 has an upper portion 416 and a lower portion 418. The hull 412 has a bow 424 and a stern 426. The kayak 10 further comprises a cockpit area 428.

Within the cockpit area 428 are first, second, and third seating surfaces 430, 432, and 434. Also in the cockpit area 428 are first, second, and third footwells 436, 438, and 440. The present invention is of particular use in the context of a kayak having three seating areas and associated footwells as disclosed herein, but may be applied to kayaks with two seating areas and associated footwells or to kayaks with four or more seating areas and associated footwells.

The first seating area 430 is located generally adjacent to the stern 426 of the kayak 410 and will be referred to as the aft seating surface. The second seating surface 432 is located forward of the aft seating surface 430 and will be referred to as the middle seating surface. The third seating surface 434 is the forwardmost of the three seating surfaces and will be referred to as the forward seating surface.

The footwell 436 is associated with the aft seating surface 430 and will be referred to as the aft footwell. The footwell 438 is associated with the middle seating surface 432 and will be referred to as the middle footwell. Similarly, the third footwell 440 is associated with the forward seating surface 434 and will be referred to as the forward footwell.

Each of the exemplary footwells 436, 438, and 440 comprises first and second footwell portions. In particular, the aft footwell 436 comprises a first portion 442 and a second portion 444. The middle footwell 438 comprises a first portion 446 and a second portion 448. The forward footwell 440 comprises a first portion 450 and a second portion 452.

In the exemplary cockpit area 428, the middle seating surface 432 is arranged between the first and second aft footwell portions 442 and 444. Similarly, the forward seating surface 434 is arranged between the first and second middle footwell portions 446 and 448.

The exemplary kayak 410 further comprises first, second, and third spacing surfaces 454, 456, and 458. Hatches may formed in these surfaces 454, 456, and 458 to allow access to the interior of the kayak 410, and hatch covers may be employed to cover the hatches to keep the interior of the kayak 410 dry. The use one or more hatches and/or hatch covers is a matter of expense and user preference and are not required to implement the principles of the present invention.

The first spacing surface 454 is arranged between the aft seating surface 430 and middle seating surface 432 and is referred to as the aft spacing surface. The second spacing surface 456 is arranged between the middle seating surface 432 and the forward seating surface 434 and will be referred to herein as the middle spacing surface. The third spacing surface 458 is arranged in front of the forward seating surface 434 and will be referred to as the forward spacing surface. The forward spacing surface 458 is arranged between the first and second forward footwell portions 450 and 452.

Referring now to FIG. 21, it can be seen that the various seating surfaces 430–434 and spacing surfaces 454–458 are arranged in the following sequence from stern 426 to bow 424: aft seating surface 430; aft spacing surface 454; middle seating surface 432; middle spacing surface 456; forward seating surface 434; and forward spacing surface 458. Between the forward spacing surface 458 and the bow 424 is a bow upper surface 466.

As shown in FIG. 21, these surfaces 430, 454, 432, 456, 434, 458, and 466 form a seating deck 468 that extends through the middle of the cockpit area 458 and has contours generally matching that of a perimeter wall 470 that extends almost entirely around the cockpit area 428. This seating deck 468 divides the footwells 436, 438, and 440 into the footwell portions 442–452 as described above.

The seating surfaces 430, 432, and 434 are preferably slightly concave or contoured to provide a more comfortable seating area. However, any surface that is comfortable for an average person would be acceptable as a seating surface. Accordingly, a flat surface or a slightly convex surface, which would not be uncomfortable for the average person to sit on, would be considered a surface that is contoured as a seating surface.

The spacing surfaces 454, 456 and 458 are preferably planar but other shapes and contours are possible. These surfaces 454, 456, and 458 are not necessarily parallel with each other or horizontally aligned.

The exemplary footwell portions 442–452 briefly described above will now be described in further detail. Shown at 472 and 474 in FIG. 21 are left and right footwell assemblies that form the footwell portions 442–452 described above. The exemplary left footwell assembly 472 comprises a rail member 476 and first, second, and third footrest members 478*a*, 478*b*, and 478*c*. The right footwell assembly 474 comprises a rail member 480 and first, second, and third footrest members 482*a*, 482*b*, and 482*c*.

The rail members 476 and 480 are attached to the perimeter wall 470 and extend along a portion of the cockpit area 428. The footrest members 478 and 482 are movably attached to the rail members 476 such that they can be fixed at any one of a plurality or continuum of bracing positions along the rail members. The occupant of any given one of the seating surfaces will determine the appropriate bracing positions for the two footrest members associated with that given seating surface. Once the footrest members are locked into place, the occupant may uses these during paddling of the kayak 410.

FIG. 21 further shows that grooves 484 and 486 are formed in the kayak hull 412; FIG. 22 shows that the footrest members 478 and 482, as exemplified by the footrest member 478*a* and groove 484, extend into the grooves 484 and 486. The user's heels will rest on the bottoms of the grooves 484 and 486, and the user will brace his or her feet against the footrest members 478 and 482.

Referring now to FIGS. 22 and 23, shown at 488 therein is an exemplary locking system used to fix the footrest member 482*b* to the rail member 480; similar locking systems will be used with the footrest members 478 and 482, so only the locking system 488 will be described herein in detail.

The locking system 488 comprises a pin 490, a hole 492 formed in the footrest member 478*a*, and a hole 494 formed in a raised portion 496 of the rail member 480. Inserting the pin 490 through the holes 492 and 494 secures footrest member 482*b* to the rail member 480.

Other locking systems may be used in place of the locking system 488. For example, the footrest members may have a surface that, when parallel to the rail members, allows movement of the footrest members along the rail members but, when canted with respect to the rail members, frictionally engages the rail members to prevent such movement.

Another locking system may include one or more shallow projections formed on one of the footrests and the rail members and one or more holes formed in the other of the footrests and the rail members. In use, the projections engage the holes to inhibit movement of the footrests along the rails. However, lifting the footrests causes the projections to become disengaged from the holes to allow movement of the footrests along the rails.

Yet another locking system may include a threaded pin that, when rotated in one direction, frictionally engages the rails to inhibit movement of the footrests along the rails and, when rotated in another direction, disengages from the rails to allow movement of the footrests along the rails.

Other locking systems may be used.

FIGS. 22 and 23 further show that the exemplary kayak hull 412 defines a rail ledge 496 on which the rail member 476 is mounted. The rail ledge 496 extends along the groove 486; the rail member 476 is mounted on a similar rail ledge extending along the groove 484. These rail ledges facilitate mounting and alignment of the rail members 476 and 480 but are not necessary to implement the present invention.

The bottom portion 418 of the kayak hull 412 may be any size, shape, and/or configuration as appropriate to provide a stable and efficient platform for movement of the kayak 410 through water.

D. Fifth Embodiment

Figure 24:
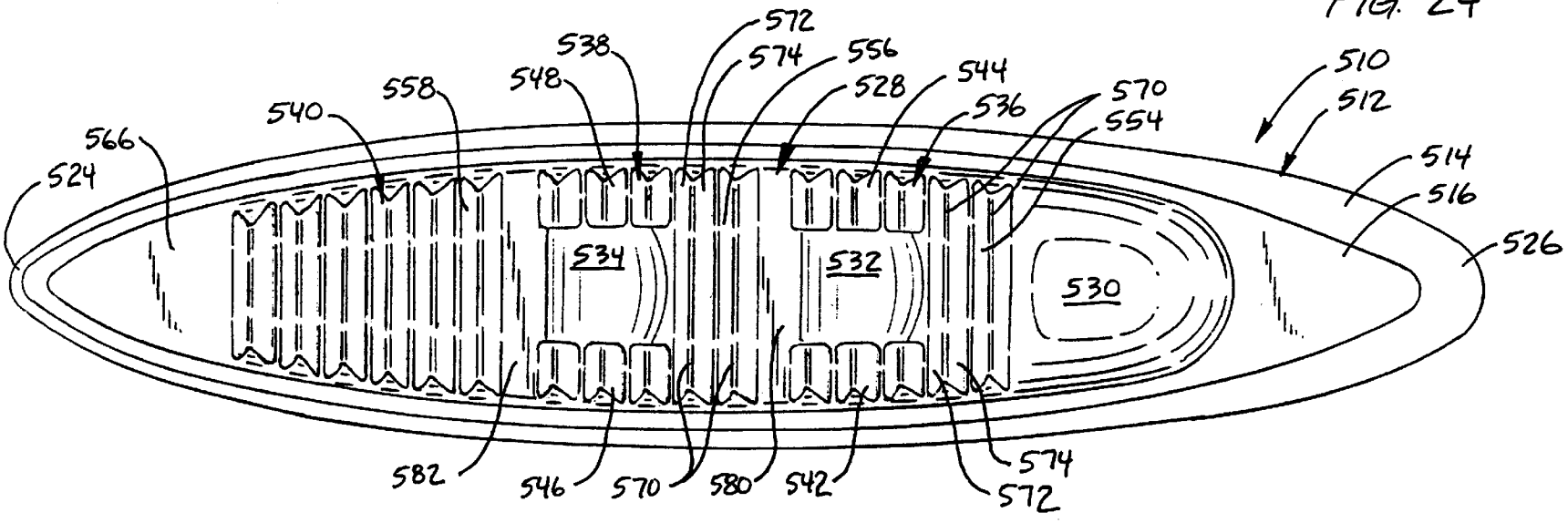
FIG. 24 is a top plan view of a fifth embodiment of the present invention.

Referring now to FIG. 24 of the drawing, depicted therein at 510 is a sit-on-top kayak constructed in accordance with, and embodying, the principles of the present invention.

The kayak 510 has a hull 512 defining a hull outer surface 514. The hull outer surface 514 has an upper portion 516 and a lower portion (not shown). The hull 512 has a bow 524 and a stern 526. The kayak 10 further comprises a cockpit area 528.

Within the cockpit area 528 are first, second, and third seating surfaces 530, 532, and 534. Also in the cockpit area 528 are first, second, and third footwells 536, 538, and 540. The present invention is of particular use in the context of a kayak having three seating areas as disclosed herein, but may be applied to kayaks with two seating areas or to kayaks with four or more seating areas.

The first seating area 530 is located generally adjacent to the stern 526 of the kayak 510 and will be referred to as the aft seating surface. The second seating surface 532 is located forward of the aft seating surface 530 and will be referred to as the middle seating surface. The third seating surface 534 is the forwardmost of the three seating surfaces and will be referred to as the forward seating surface.

The footwell 536 is associated with the aft seating surface 530 and will be referred to as the aft footwell. The footwell 538 is associated with the middle seating surface 532 and will be referred to as the middle footwell. The footwell 540 is associated with the forward seating surface 534 and will be referred to as the forward footwell.

The exemplary footwells 536 and 538 comprise first and second footwell portions. In particular, the aft footwell 536 comprises a first portion 542 and a second portion 544. The middle footwell 538 comprises a first portion 546 and a second portion 548. The forward footwell 540 does not comprise discrete footwell portions, but instead is extends from one side of the cockpit area 528 to the other.

In the exemplary cockpit area 528, the middle seating surface 532 is arranged between the first and second aft footwell portions 542 and 544. Similarly, the forward seating surface 534 is arranged between the first and second middle footwell portions 546 and 548.

The exemplary kayak 510 further comprises first and second floor surfaces 554 and 556. The floor surfaces 554 and 556 are vertically spaced below the seating surfaces 530–534. The seating surfaces 530–534 thus take the form of discrete pedestals or stools that are raised above the bottom surface of the hull 512 within the kayak cockpit area 528.

The first floor surface 554 is arranged between the aft seating surface 530 and middle seating surface 532 and is referred to as the aft floor surface. The second floor surface 556 is arranged between the middle seating surface 532 and the forward seating surface 534 and will be referred to herein as the middle floor surface.

The various seating surfaces 530–534 and floor surfaces 554–556 are arranged in the following sequence from stern 526 to bow 524: aft seating surface 530; aft floor surface 554; middle seating surface 532; middle floor surface 556; forward seating surface 534; and forward footwell 540. Between the forward floor surface 558 and the bow 554 is a bow upper surface 566.

The footwells 536, 538, and 540 and floor surfaces 554 and 556 are generally at the same horizontal level and are spaced below the seating surfaces 530, 532, and 534.

The seating surfaces 530, 532, and 534 are preferably slightly concave or contoured to provide a more comfortable seating area. However, any surface that is comfortable for an average person would be acceptable as a seating surface. Accordingly, a flat surface or a slightly convex surface, which would not be uncomfortable for the average person to sit on, would be considered a surface that is contoured as a seating surface.

The exemplary footwell portions 542–548 are similar to the footwell portions 42–52 described above and will not be described herein in further detail.

The forward footwell 540 and floor surfaces 554 and 556 are preferably formed by discrete grooves 570 comprising bracing surfaces 572 and resting surfaces 574 similar to those that form the footwell portions 542–548. These grooves 570 extend from one side of the cockpit area 528 to the other.

However, the footwells 536–540 and floor surfaces 554 and 556 may be planar, and other shapes and contours are also possible. The footwells 536–540 and surfaces 554, 556, and 558 are not necessarily parallel with each other or horizontally aligned.

The exemplary kayak 510 comprises aft and forward spacing surfaces 580 and 582. The aft spacing surface 580 is arranged between the middle seating surface 532 and the middle floor surface 554. The forward spacing surface 582 is arranged between the forward seating surface 534 and the forward footwell 540. The spacing surfaces 580 and 582 may be replaced by an additional groove such as the grooves 570.

The bottom portion (not shown) of the kayak hull 512 may be any size, shape, and/or configuration as appropriate to provide a stable and efficient platform for movement of the kayak 510 through water.

E. Sixth Embodiment

Figure 25:
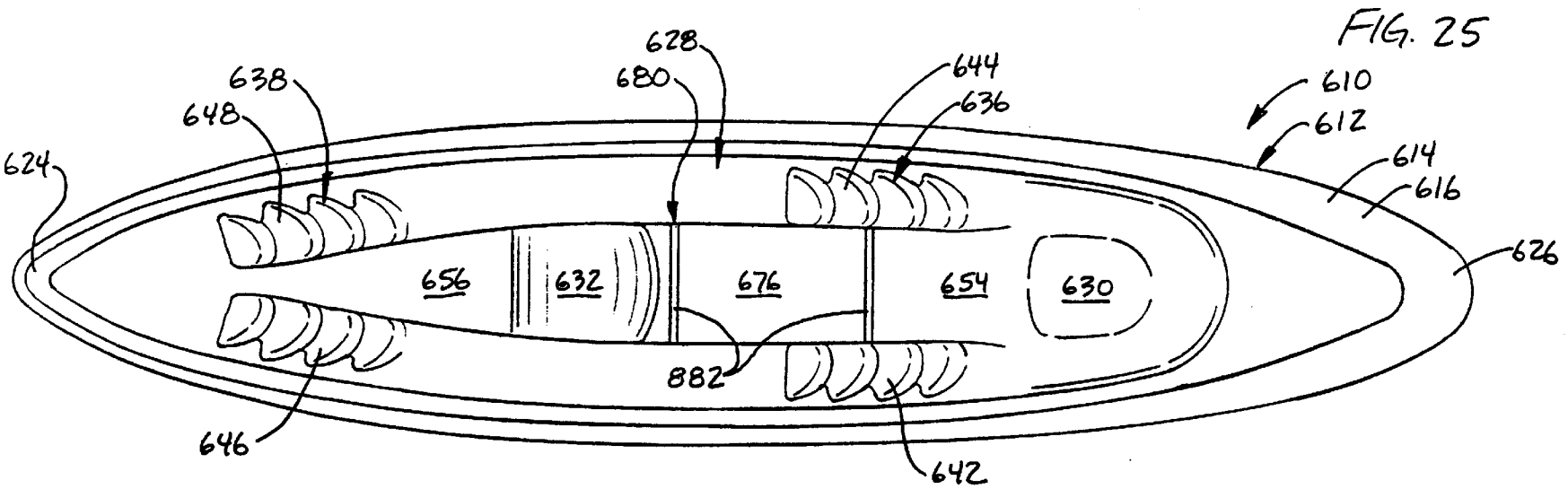
FIG. 25 is a top plan view of a kayak of a sixth embodiment of the present invention.
Figure 26:
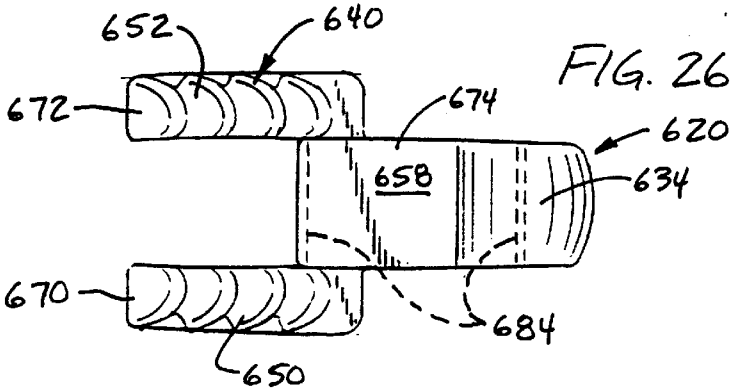
FIG. 26 is a top plan view of an optional seat member that may be used with the kayak of FIG. 25.
Figure 27:
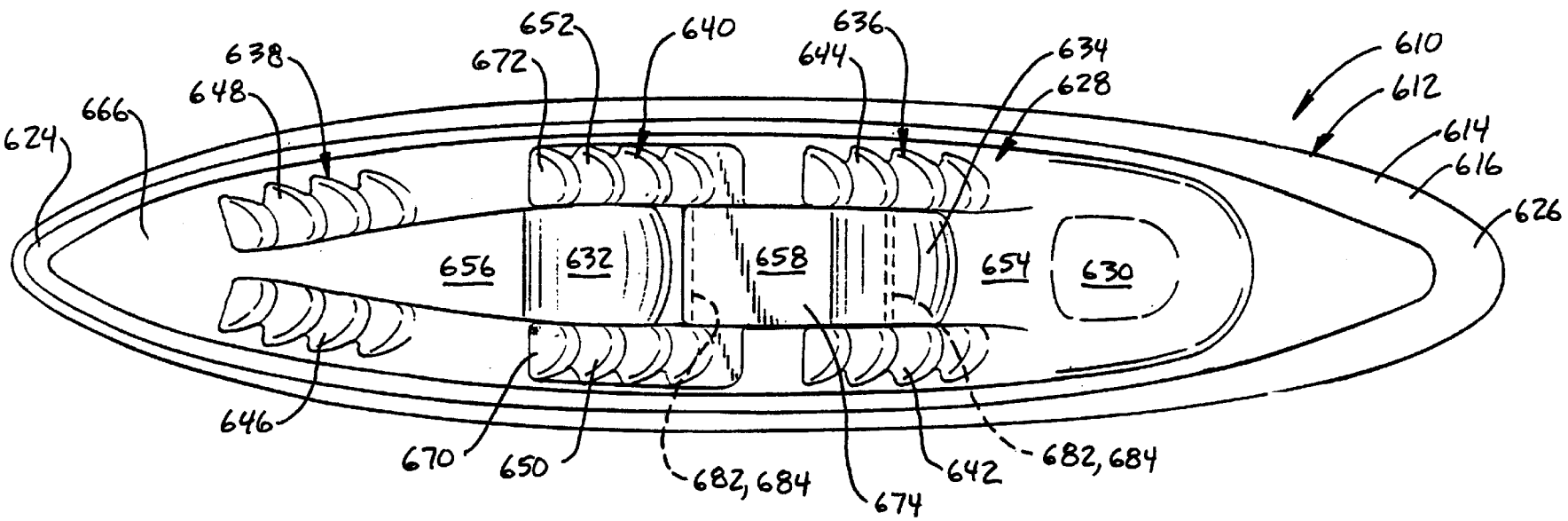
FIG. 27 is a top plan view showing the seat member of FIG. 26 used with the kayak of FIG. 25.

Referring now to FIGS. 25–27 of the drawing, depicted therein at 610 is a sit-on-top kayak constructed in accordance with, and embodying, the principles of the present invention.

The kayak 610 has a hull 612 defining a hull outer surface 614. The hull outer surface 614 has an upper portion 616 and a lower portion (not shown). The kayak further optionally comprises a seat member 620. The hull 612 has a bow 624 and a stern 626. The kayak 10 further comprises a cockpit area 628.

Within the cockpit area 628 are first and second seating surfaces 630 and 632. A third seating surface 634 is formed on the seat member 620. Also in the cockpit area 628 are first and second footwells 636 and 638. A third footwell 640 is formed on the seat member 620.

The present invention is of particular use in the context of a kayak having three seating areas as disclosed herein, but may be applied to kayaks with one or two seating areas or to kayaks with three, four, or more seating areas.

The first seating area 630 is located generally adjacent to the stern 626 of the kayak 610 and will be referred to as the aft seating surface. The second seating surface 632 is, during use, the forwardmost of the three seating surfaces and will be referred to as the forward seating surface. The third seating surface 634, if used, is located forward of the aft seating surface 630 and behind the forward seating surface 632. The third seating surface 634 will be referred to as the middle, movable, or optional seating surface.

The first footwell 636 is associated with the aft seating surface 630 and will be referred to as the aft footwell. The footwell 638 is associated with the forward seating surface 632 and will be referred to as the forward footwell. The footwell 640 is associated with the middle seating surface 634 and will be referred to as the middle, optional, or movable footwell.

Each of the exemplary footwells 636, 638, and 640 comprises first and second footwell portions. In particular, the aft footwell 636 comprises a first portion 642 and a second portion 644. The forward footwell 638 comprises a first portion 646 and a second portion 648. The middle footwell 640 comprises a first portion 650 and a second portion 652.

The exemplary kayak 610 may be used without the seat member 620 as shown in FIG. 25 or with the seat member 620 1s arranged in the cockpit area 628 as shown in FIG. 27. Without the seat member 620, the seating configuration of the kayak 610 is generally conventional: the aft footwell 636 is spaced behind the forward seating surface 632.

When the seat member is placed in the cockpit area 628, the middle seating surface 634 is arranged between the first and second aft footwell portions 642 and 644 and the forward seating surface 632 is arranged between the first and second middle footwell portions 650 and 652.

The exemplary kayak 610 further comprises first and second spacing surfaces 654 and 656. A third spacing surface 658 is formed on the seat member 620. Hatches may formed in these surfaces 654, 656, and 658 to allow access to the interior of the kayak 610 and/or seat member 620, and hatch covers may be employed to cover the hatches to keep the interior of the kayak 10 dry. The use one or more hatches and/or hatch covers is a matter of manufacturing expense and user preference and are not required to implement the principles of the present invention.

The first spacing surface 654 is arranged immediately in front of the aft seating surface 630 and is referred to as the aft spacing surface. The second spacing surface 656 is arranged in front of the forward seating surface 632 and will be referred to as the forward spacing surface. When the seat member 20 is placed in the cockpit area 628 during use, the third spacing surface 658 is arranged between the middle seating surface 634 and the forward seating surface 632 and will be referred to herein as the middle spacing surface. The forward spacing surface 656 is arranged between the first and second forward footwell portions 646 and 648.

Referring now to FIG. 27, it can be seen that, when the seat member 620 is in use, the various seating surfaces 630–634 and spacing surfaces 654–658 are arranged in the following sequence from stern 626 to bow 624: aft seating surface 630; aft spacing surface 654; middle seating surface 634; middle spacing surface 658; forward seating surface 632; and forward spacing surface 656. Between the forward spacing surface 656 and the bow 624 is a bow upper surface 666.

The seating surfaces 630, 632, and 634 are preferably slightly concave or contoured to provide a more comfortable seating area. However, any surface that is comfortable for an average person would be acceptable as a seating surface. Accordingly, a flat surface or a slightly convex surface, which would not be uncomfortable for the average person to sit on, would be considered a surface that is contoured as a seating surface.

The spacing surfaces 654, 656 and 658 are preferably planar but other shapes and contours are possible. These surfaces 654, 656, and 658 are not necessarily parallel with each other or horizontally aligned.

The exemplary footwell portions 642–648 briefly described above will now be described in further detail. The first and second aft footwell portions 642 and 644 and first and second forward footwell portions 646 and 648 are or may be like any of the aft or forward footwell portions described above with reference to the first, fourth, and fifth embodiments. The exemplary footwell portions 642–648 are, however, similar to the footwell portions 42, 44, 50, and 52 described above and will not be described in further detail herein.

The middle footwell portions 650 and 652 not formed in the hull 612 but rather are formed on footwell projections 670 and 672 that extend forwardly from a main body 674 of the seating member 620 on either side of and below the middle seating surface 634. The middle footwell portions 650 and 652 are comprised of resting and bracing surfaces similar to the footwell portions 42–52 described above, but other shapes and configurations may be used.

The main body 674 rests on a support surface 676 formed in the cockpit area 628 between the rear spacing surface 654 and the forward seating surface 632. The support surface 676 may be at approximately the same vertical height as the rear spacing surface 654 and the forward seating surface 632. In this case, the main body 674 will be relatively thin so that the middle seating surface 634 is not significantly higher than the aft and forward seating surfaces 630 and 632.

The support surface 676 may also be somewhat lower than the adjacent rear spacing surface 630 and forward seating surface 632. In this case, the main body 674 will be relatively thick so that the middle seating surface 634 is at approximately the same height as the other seating surfaces 630 and 632. In any event, the middle seating surface 634 should not be significantly higher or lower than the other seating surfaces 630 and 632.

Referring again to FIGS. 25 and 26, shown at 680 therein is an exemplary locking system used to inhibit movement between the seat member 620 and the hull 612. In particular, grooves (or projections) 682 are formed in the support surface 676, while projections (or grooves) 684 are formed on the underside of the main body 674 of the seat member 620.

The grooves receive the projections such that the forward or rearward movement of the seat member 620 relative to the hull 612 is inhibited, especially when the middle seating surface 634 is occupied. A plurality of grooves or projections may be formed on the support surface 676 and/or the main body 674 to allow the position of the middle seating surface 634 relative to the aft seating surface 630 to be adjusted.

F. Seventh Embodiment

Figure 28:
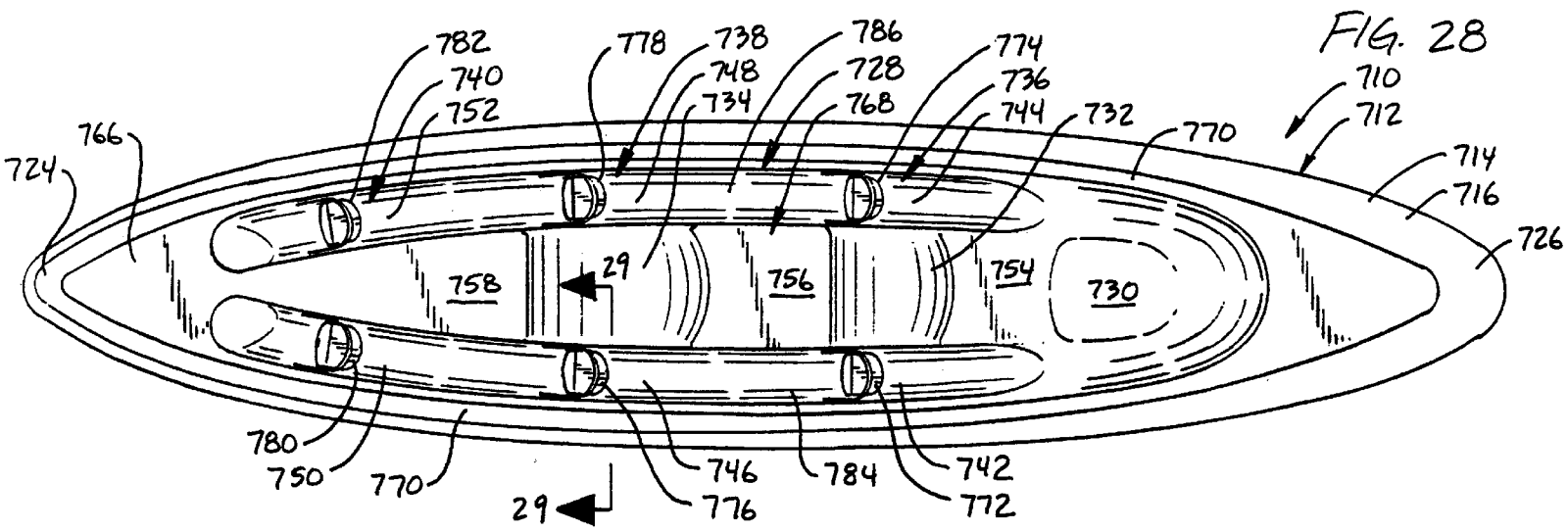
FIG. 28 is a top plan view of a seventh embodiment of the present invention.
Figure 29:
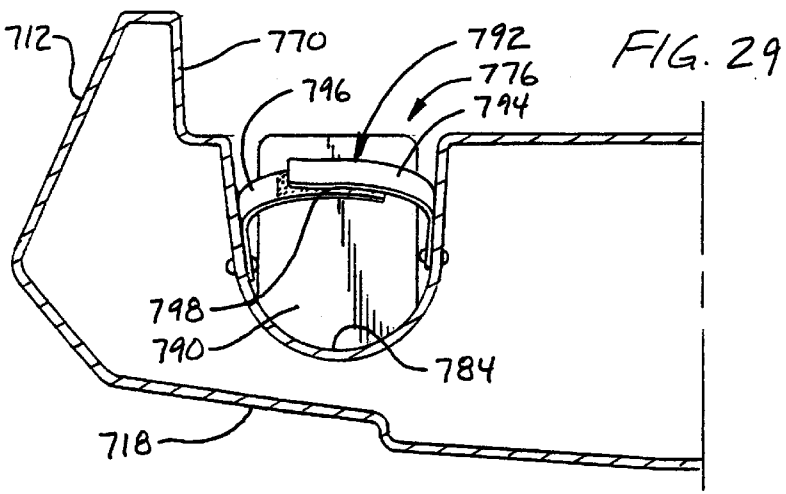
FIG. 29 is a section view taken along lines 29—29 in FIG. 28.

Referring now to FIGS. 28 and 29 of the drawing, depicted therein at 710 is a seventh embodiment of a sit-on-top kayak constructed in accordance with, and embodying, the principles of the present invention.

The kayak 710 has a hull 712 defining a hull outer surface 714. The hull outer surface 714 has an upper portion 716 and a lower portion 718. The hull 712 has a bow 724 and a stern 726. The kayak 10 further comprises a cockpit area 728.

Within the cockpit area 728 are first, second, and third seating surfaces 730, 732, and 734. Also in the cockpit area 728 are first, second, and third footwells 736, 738, and 740. The present invention is of particular use in the context of a kayak having three seating areas and associated footwells as disclosed herein, but may be applied to kayaks with two seating areas and associated footwells or to kayaks with four or more seating areas and associated footwells.

The first seating area 730 is located generally adjacent to the stern 726 of the kayak 710 and will be referred to as the aft seating surface. The second seating surface 732 is located forward of the aft seating surface 730 and will be referred to as the middle seating surface. The third seating surface 734 is the forwardmost of the three seating surfaces and will be referred to as the forward seating surface.

The footwell 736 is associated with the aft seating surface 730 and will be referred to as the aft footwell. The footwell 738 is associated with the middle seating surface 732 and will be referred to as the middle footwell. Similarly, the third footwell 740 is associated with the forward seating surface 734 and will be referred to as the forward footwell.

Each of the exemplary footwells 736, 738, and 740 comprises first and second footwell portions. In particular, the aft footwell 736 comprises a first portion 742 and a second portion 744. The middle footwell 738 comprises a first portion 746 and a second portion 748. The forward footwell 740 comprises a first portion 750 and a second portion 752.

In the exemplary cockpit area 728, the middle seating surface 732 is arranged between the first and second aft footwell portions 742 and 744. Similarly, the forward seating surface 734 is arranged between the first and second middle footwell portions 746 and 748.

The exemplary kayak 710 further comprises first, second, and third spacing surfaces 754, 756, and 758. Hatches may formed in these surfaces 754, 756, and 758 to allow access to the interior of the kayak 710, and hatch covers may be employed to cover the hatches to keep the interior of the kayak 10 dry. The use one or more hatches and/or hatch covers is a matter of expense and user preference and are not required to implement the principles of the present invention.

The first spacing surface 754 is arranged between the aft seating surface 730 and middle seating surface 732 and is referred to as the aft spacing surface. The second spacing surface 756 is arranged between the middle seating surface 732 and the forward seating surface 734 and will be referred to herein as the middle spacing surface. The third spacing surface 758 is arranged in front of the forward seating surface 734 and will be referred to as the forward spacing surface. The forward spacing surface 758 is arranged between the first and second forward footwell portions 750 and 752.

Referring now to FIG. 28, it can be seen that the various seating surfaces 730–734 and spacing surfaces 754–758 are arranged in the following sequence from stern 726 to bow 724: aft seating surface 730; aft spacing surface 754; middle seating surface 732; middle spacing surface 756; forward seating surface 734; and forward spacing surface 758. Between the forward spacing surface 758 and the bow 754 is a bow upper surface 766.

As shown in FIG. 16, these surfaces 730, 754, 732, 756, 734, 758, and 766 form a seating deck 768 that extends through the middle of the cockpit area 758 and has contours generally matching that of a perimeter wall 770 that extends almost entirely around the cockpit area 728. This seating deck 768 divides the footwells 736, 738, and 740 into the footwell portions 742–752 as described above.

The seating surfaces 730, 732, and 734 are preferably slightly concave or contoured to provide a more comfortable seating area. However, any surface that is comfortable for an average person would be acceptable as a seating surface. Accordingly, a flat surface or a slightly convex surface, which would not be uncomfortable for the average person to sit on, would be considered a surface that is contoured as a seating surface.

The spacing surfaces 754, 756 and 758 are preferably planar but other shapes and contours are possible. These surfaces 754, 756, and 758 are not necessarily parallel with each other or horizontally aligned.

The exemplary footwell portions 742–752 briefly described above will now be described in further detail. The footwell portions 742, 744, 746, 748, 750, and 752 are formed by first, second, third fourth, fifth, and sixth footrest assemblies 772, 774, 776, 778, 780, and 782, respectively.

FIG. 29 shows that the first footrest assembly 772 is attached to the perimeter wall 770. The other footrest members 774–782 are similarly attached to the perimeter wall 770.

FIG. 29 further shows that grooves 784 and 786 are formed in the kayak hull 712 and that the footrest assemblies 774–782, as exemplified by the footrest member 772 and the groove 784, extend into the grooves 784 and 786. The user's heels will rest on the bottoms of the grooves 784 and 786, and the user will brace his or her feet against the footrest assemblies 772–782.

The exemplary footrest assemblies 772–782 are identical and only the footrest assembly 776 will be described herein in detail. As shown in FIG. 29, the footrest assembly 776 comprises a footrest member 790 and a strap assembly 792. The footrest member 790 is rigidly attached to the hull 712 such that it extends upwardly and forwardly from the hull 712.

The exemplary strap assembly 792 comprises first and second strap members 794 and 796 each rigidly attached at one end to the hull 712. A fastener system 798 such as a buckle or hook/loop fasteners is employed to connect the strap members 794 and 796 together to secure the user's foot to the hull 712.

Other fastening systems may be used in place of the fastening system 798. For example, a number of pairs of sockets may be formed along the length of the hull 712, and fasteners inserted into these sockets to attach footrest members 790 and/or the free ends of the strap members to the hull 712. This arrangement would allow the strap assemblies to be attached at different locations on the kayak. In addition, instead of attaching the strap members to the hull, the strap members may be attached to the footrest members which are in turn attached to the hull.

The bottom portion 718 of the kayak hull 712 may be any size, shape, and/or configuration as appropriate to provide a stable and efficient platform for movement of the kayak 710 through water.

G. Eighth Embodiment

Figure 30:
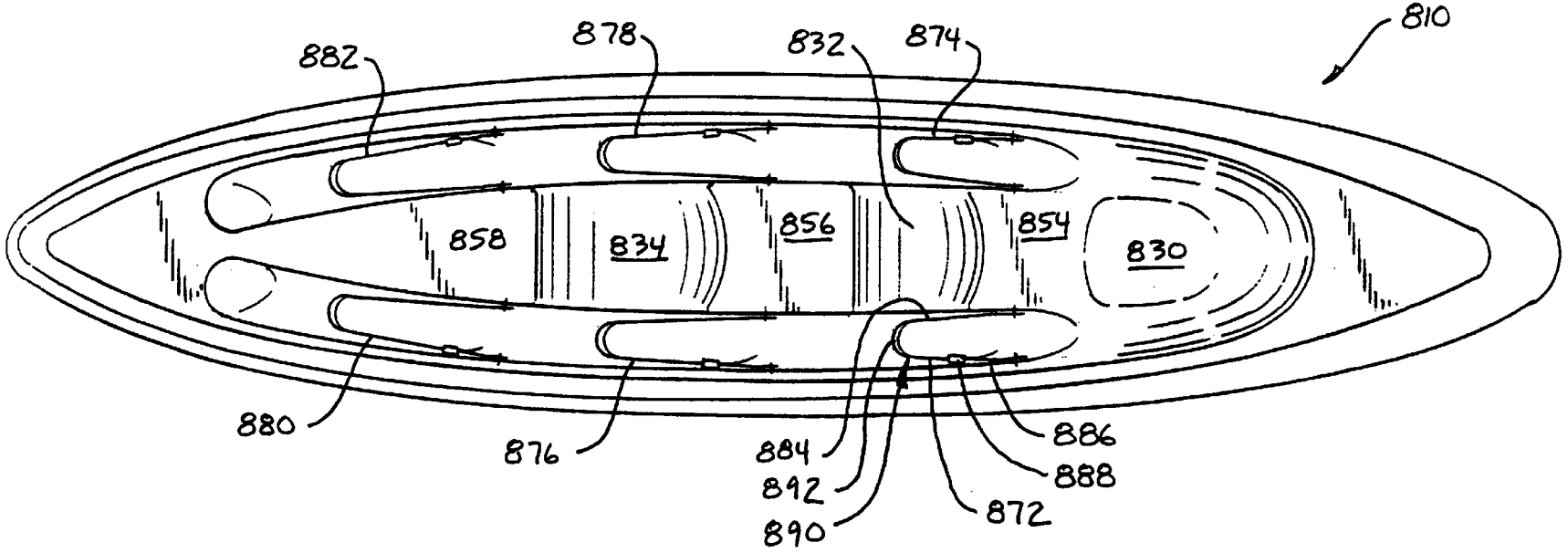
FIG. 30 is a top plan view of an eight embodiment of a kayak constructed in accordance with, and embodying, the principles of the present invention.

Referring now to FIG. 30 of the drawing, depicted therein at 810 is an eighth embodiment of a sit-on-top kayak constructed in accordance with, and embodying, the principles of the present invention. The kayak 810 is in most respects similar to the kayak 710 and will be described herein only to the extent that it differes from the kayak 710. The reference characters used in the discussion of the kayak 810 will be the same as those used in the discussion of the kayak 710 increased by one hundred.

The primary difference between the kayak 810 and the kayak 710 previously discussed is the construction of the footrest assemblies 872–882 used to form the footwell portions 742–752.

The footrest assemblies 872–882 are identical and only the footrest assembly 872 will be describe herein in detail with the understanding that this description applies to the other footrest assemblies 874–882.

FIG. 30 shows that the footrest assembly 872 comprises first and second strap members 884 and 886 and a buckle member 888. One end of each of the strap members 884 and 886 is attached to the hull 812 by pop rivets, spin welds, nuts and bolts, or the like. The other ends of the strap members 884 and 886 are connected together by the buckle member 888 to form a strap assembly 890 that is generally in the shape of a "U", where the open end of the U-shaped strap assembly 890 is adjacent to and faces the rear seating surface 830 and the closed end receives one of the user's feet.

The first strap member 884 is longer than the second strap member 886 such that a bracing surface 892 is formed by the first strap member 884. The user's foot comes into contact with the bracing surface 892 when inserted into the U-shaped strap assembly 890.

The buckle member 888 is or may be conventional and joins the strap members 884 and 886 together such that an effective length of the strap assembly 890 may be increased and decreased. The bracing surface 892 is defined by the closed end of the U-shaped strap assembly 890 and thus will move along the first strap member 884 as the effective length of the strap assembly 890 changes. The bracing surface 892 will thus move towards and away from the rear seating surface 830 to accommodate user's of different stature.

The footrest assemblies 872–882 are each associated with a given seating surface: the assemblies 872 and 874 with the aft seating surface 830; the assemblies 876 and 878 with the middle seating surface 832; and the assemblies 880 and 882 with the forward seating surface 834.

The bracing surfaces 892 defined by the footrest assemblies 872 and 874 will thus, in normal use, be arranged on either side of the middle seating surface 832; similarly, the bracing surfaces 892 defined by the footrest assemblies 876 and 878 will be arranged on either side of the forward seating surface 834. The bracing surfaces 892 associated with the footrest assemblies 880 and 882 will be in front of the forward seating surface 834 on either side of the forward spacing surface 858.

H. Ninth Embodiment

Figure 31:
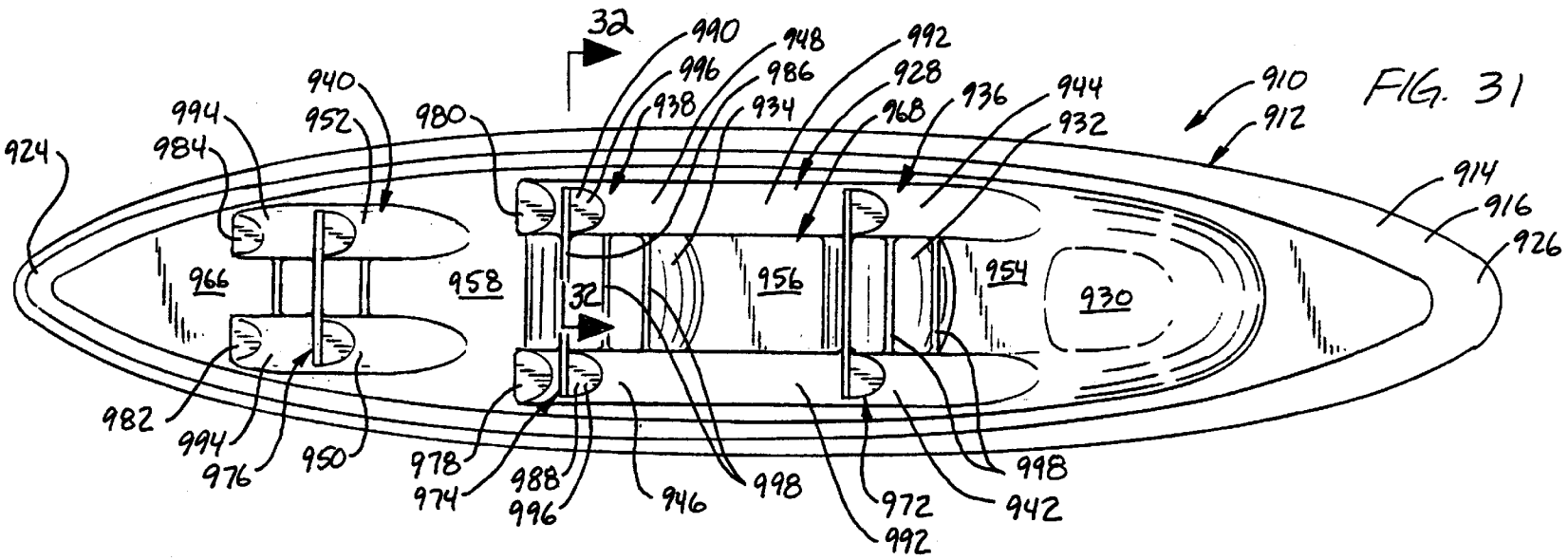
FIG. 31 is a top plan view of a ninth embodiment of a kayak incorporating the principles of the present invention.
Figure 32:
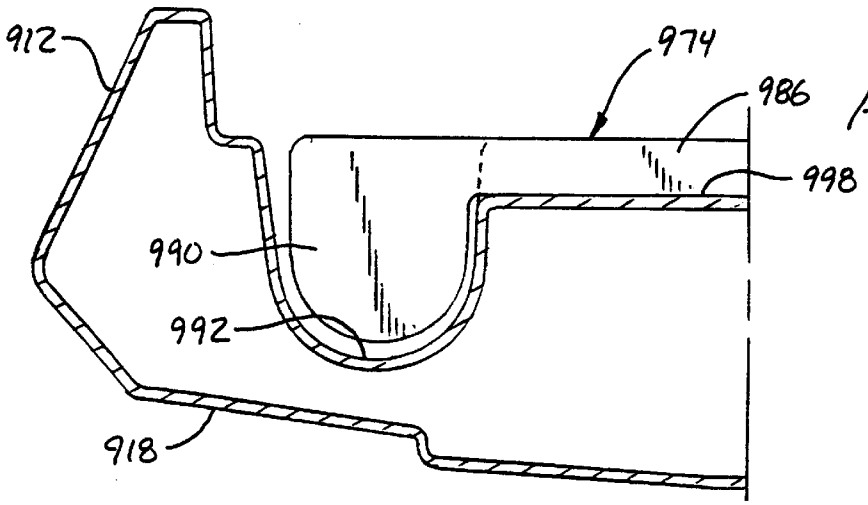
FIG. 32 is a section view taken along lines 32—32 in FIG. 31.

Referring now to FIGS. 31 and 32 of the drawing, depicted at 910 therein is a ninth embodiment of a sit-on-top kayak constructed in accordance with, and embodying, the principles of the present invention.

The kayak 910 has a hull 912 defining a hull outer surface 914. The hull outer surface 914 has an upper portion 916 and a lower portion 918. The hull 912 has a bow 924 and a stern 926. The kayak 10 further comprises a cockpit area 928.

Within the cockpit area 928 are first, second, and third seating surfaces 930, 932, and 934. Also in the cockpit area 928 are first, second, and third footwells 936, 938, and 940. The present invention is of particular use in the context of a kayak having three seating areas and associated footwells as disclosed herein, but may be applied to kayaks with two seating areas and associated footwells or to kayaks with four or more seating areas and associated footwells.

The first seating area 930 is located generally adjacent to the stern 926 of the kayak 910 and will be referred to as the aft seating surface. The second seating surface 932 is located forward of the aft seating surface 930 and will be referred to as the middle seating surface. The third seating surface 934 is the forwardmost of the three seating surfaces and will be referred to as the forward seating surface.

The footwell 936 is associated with the aft seating surface 930 and will be referred to as the aft footwell. The footwell 938 is associated with the middle seating surface 932 and will be referred to as the middle footwell. Similarly, the third footwell 940 is associated with the forward seating surface 934 and will be referred to as the forward footwell.

Each of the exemplary footwells 936, 938, and 940 comprises first and second footwell portions. In particular, the forward footwell 936 comprises a first portion 942 and a second portion 944. The middle footwell 938 comprises a first portion 946 and a second portion 948. The forward footwell 940 comprises a first portion 950 and a second portion 952.

In the exemplary cockpit area 928, the middle seating surface 932 is arranged between the first and second aft footwell portions 942 and 944. Similarly, the forward seating surface 934 is arranged between the first and second middle footwell portions 946 and 948.

The exemplary kayak 910 further comprises first, second, and third spacing surfaces 954, 956, and 958. Hatches may formed in these surfaces 954, 956, and 958 to allow access to the interior of the kayak 910, and hatch covers may be employed to cover the hatches to keep the interior of the kayak 10 dry. The use one or more hatches and/or hatch covers is a matter of expense and user preference and are not required to implement the principles of the present invention.

The first spacing surface 954 is arranged between the aft seating surface 930 and middle seating surface 932 and is referred to as the aft spacing surface. The second spacing surface 956 is arranged between the middle seating surface 932 and the forward seating surface 934 and will be referred to herein as the middle spacing surface. The third spacing surface 958 is arranged in front of the forward seating surface 934 and will be referred to as the forward spacing surface. The forward spacing surface 958 is arranged between the first and second forward footwell portions 950 and 952.

Referring now to FIG. 31, it can be seen that the various seating surfaces 930–934 and spacing surfaces 954–958 are arranged in the following sequence from stern 926 to bow 924: aft seating surface 930; aft spacing surface 954; middle seating surface 932; middle spacing surface 956; forward seating surface 934; and forward spacing surface 958. Between the forward spacing surface 958 and the bow 954 is a bow upper surface 966.

As shown in FIG. 31, these surfaces 930, 954, 932, 956, 934, 958, and 966 form a seating deck 968 that extends through the middle of the cockpit area 928 and has contours generally matching that of a perimeter wall 970 that extends almost entirely around the cockpit area 928. This seating deck 968 divides the footwells 936, 938, and 940 into the footwell portions 942–952 as described above.

The seating surfaces 930, 932, and 934 are preferably slightly concave or contoured to provide a more comfortable seating area. However, any surface that is comfortable for an average person would be acceptable as a seating surface. Accordingly, a flat surface or a slightly convex surface, which would not be uncomfortable for the average person to sit on, would be considered a surface that is contoured as a seating surface.

The spacing surfaces 954, 956 and 958 are preferably planar but other shapes and contours are possible. These surfaces 954, 956, and 958 are not necessarily parallel with each other or horizontally aligned.

The exemplary footwell portions 942–952 briefly described above will now be described in further detail. The footwell portions 942, 944, 946, 948, 950, and 952 may be formed by first, second, and third footrest members 972, 974, and 976 or by first, second, third, or fourth hull bracing surfaces 978, 980, 982, and 984.

The exemplary footrest members 972–976 are similar to each other in the preferred embodiment, so only the footrest member 974 will be described herein in detail. The footrest member 972 is identical to the footrest member 974, and the footrest member 976 is similar but slightly smaller as will be discussed below.

The footrest member 974 comprises a central portion 986 and first and second bracing portions 988 and 990. The central portion 986 is sized and dimensioned to extend across the middle seating surface 932, while the bracing portions 988 and 990 extend into grooves 992 formed in the kayak hull 912 as shown in FIG. 32. The grooves 992 extend from just in front of the aft seating surface 930 to just in front of the forward seating surface 934. Separate grooves 994 are formed in the kayak hull 912 slightly forward of the forward seating surface 934.

During use, the user's heels will rest on the bottoms of the grooves 992 and 994, and the user will brace his or her feet against a bracing surface 996 formed each of the bracing portions 988 and 990 of the footrest members 972–976. Alternatively, a taller user sitting on the middle or forward seating surfaces 932 and 934 may elect not to use a footrest member and brace his or her feet against the hulls bracing surfaces 978, 980, 982, and 984.

In the exemplary kayak 910, grooves 998 are formed in the middle and forward seating surfaces 932 and 934 and in the forward spacing surface 958. As shown in FIG. 32, the grooves 998 receive the central portions 986 of the footrest members 972–976 to inhibit movement of these members 972–976 relative to the hull 712. Because the forward spacing surface 958 is narrower than the seating surfaces 932 and 934, the central portion 986 of the footrest member 976 is shorter than the central portion 986 of the footrest members 972 and 974.

The grooves 998 should be large enough to allow the central portions 986 of the footrest members 972–976 to be structurally sound but small enough not to cause discomfort to an occupant of the seating areas 632 and 634.

The bottom portion 916 of the kayak hull 912 may be any size, shape, and/or configuration as appropriate to provide a stable and efficient platform for movement of the kayak 910 through water.

I. Summary

From the foregoing, it should be clear that the present invention may be embodied in forms other than those described above. For example, the types of footwell portions employed in any given kayak may be mixed: a kayak could some have footwell portions integrally molded into the hull as in first, fifth, sixth, and seventh embodiments, some footwell portions formed by separate assemblies as described in the fourth, seventh, and eighth embodiments, and some footwell portions formed by separate members such as in the sixth and ninth embodiments.

Another example would be to replace the footwell portions 670 and 672 of the sixth embodiment with the footwell assemblies of the fourth, seventh, and eighth embodiments.

Yet another example would be to eliminate the spacing surfaces of the first, sixth, seventh, eighth, and ninth embodiments and support surface of the sixth embodiment to obtain pedestal seats such as are described in the fifth embodiment.

In addition, instead of a pair of elongate grooves in the hull as described in the fourth, seventh, and eighth embodiments, two pairs of elongate grooves as disclosed in the ninth embodiment or even three pairs of elongate grooves may be used.

Such factors as cost, user or dealer preference, manufacturing considerations, retrofit considerations, and the like will determine the configuration of a given kayak.

Accordingly, the present invention may be embodied in other forms without departing from the scope thereof. The above described embodiment is therefore to be considered in all respects illustrative and not restrictive, the scope of the invention being indicated by the appended claims rather than the foregoing description. All changes that come within the meaning and scope of the claims are intended to be embraced therein.

What is claimed is:

1. A sit-on-top kayak, comprising:

a hull having a hull outer surface and defining a bow, a stern and a cockpit area;

first and second seating discrete surfaces formed on the hull outer surface within the cockpit area, where the first seating surface is arranged aft of the second seating surface; and a footwell associated with each of the first and second seating surfaces, each footwell having a first footwell portion and second footwell portion; wherein the first and second footwell portions associated with the first seating surface are arranged on either side of the second seating surface.

2. A sit-on-top kayak, comprising:

a hull defining a bow, a stern and a cockpit area;

first and second seating surfaces arranged within the cockpit area, where the first seating surface is arranged aft of the second seating surface; and a footwell associated with each of the first and second seating surfaces; wherein the footwell associated with the first seating surface is arranged relative to the second seating surface such that at least a portion of the legs of an occupant of the first seating surface straddle the second seating surface.

3. A sit-on-top kayak as recited in claim 2, in which part of the footwell associated with the first seating surface is lateral of the second seating surface.

4. A sit-on-top kayak as recited in claim 2, in which part of the footwell associated with the first seating surface straddles the second seating surface.

5. A sit-on-top kayak as recited in claim 2, the footwell associated with the first seating surface comprises a bracing surface arranged forward of the second seating surface.

6. A sit-on-top kayak as recited in claim 3, the footwell associated with the first seating surface comprises a bracing surface arranged forward of the second seating surface.

7. A sit-on-top kayak, comprising:

a hull defining a bow, a stern and a cockpit area;

first and second seating surfaces formed within the cockpit area, where the first seating surface is arranged aft of the second seating surface; and a footwell associated with the first seating surface, the footwell comprising a bracing surface; wherein the bracing surface is arranged forward of the second seating surface.

8. A sit-on-top kayak as recited in claim 7, in which part of the footwell is lateral of the second seating surface.

9. A sit-on-top kayak as recited in claim 7, in which part of the footwell straddles the second seating surface.

10. A sit-on-top kayak, comprising:

a hull having a bow, a stern, and perimeter wall extending at least partly around a cockpit area;

first and second seating surfaces formed within the cockpit area, where the first seating surface is arranged aft of the second seating surface; and a footwell associated with the first seating surface, the footwell comprising first and second bracing surfaces; wherein the first and second bracing surfaces are arranged substantially between the second seating surface and the perimeter wall.

11. A sit-on-top kayak as recited in claim 10, in which part of the footwell is lateral of the second seating surface.

12. A sit-on-top kayak as recited in claim 10, in which part of the footwell straddles the second seating surface.

13. A sit-on-top kayak as recited in claim 10, the first and second bracing surfaces are arranged forward of the second seating surface.

* * * * *